US006342684B1

(12) United States Patent
Myojin

(10) Patent No.: US 6,342,684 B1
(45) Date of Patent: Jan. 29, 2002

(54) DEVICE FOR DETECTING OBJECTS MOVED DOWNWARDLY TO OPERATE A SWITCH

(75) Inventor: Satoshi Myojin, Tokyo (JP)

(73) Assignee: Mitsuku Denshi Kogyo K. K., Tokyo (JP)

( * ) Notice: Subject to any disclaimer, the term of this patent is extended or adjusted under 35 U.S.C. 154(b) by 0 days.

(21) Appl. No.: 09/500,906

(22) Filed: Feb. 9, 2000

(30) Foreign Application Priority Data

Jul. 21, 1999 (JP) ..... 11-206773

(51) Int. Cl.[7] ..... H01H 35/00

(52) U.S. Cl. ..... 200/52 R; 439/188

(58) Field of Search ..... 200/16 R, 16 D, 200/51 R, 51.09, 51.1, 52 R, 61.41, 61, 58 R, 59, 275

(56) References Cited

U.S. PATENT DOCUMENTS

| | | | | | |
|---|---|---|---|---|---|
| 3,858,019 | A | * | 12/1974 | Muri et al. | 200/159 A |
| 4,685,887 | A | * | 8/1987 | Hanning | 439/188 |
| 4,885,435 | A | * | 12/1989 | Dix | 200/1 B |
| 4,920,245 | A | * | 4/1990 | Takano et al. | 200/533 |
| 5,278,370 | A | | 1/1994 | Miyata et al. | |
| 5,647,754 | A | * | 7/1997 | Kohno | 439/188 |
| 5,989,046 | A | * | 11/1999 | Togashi | 439/188 |
| 6,045,049 | A | * | 4/2000 | Nishimura et al. | 235/486 |

* cited by examiner

*Primary Examiner*—Paula Bradley
*Assistant Examiner*—Nhung Nguyen
(74) *Attorney, Agent, or Firm*—Oblon, Spivak, McClelland, Maier & Neustadt, P.C.

(57) ABSTRACT

A device for detecting the movement of an object in order to operate a switch, wherein a top or contact of an angled contact part of a contact spring piece of the device comes into contact with a set position of an object, such as a digital video cassette ( DVC) or other cassette or disk which is being transferred so that various kinds of detecting operations are performed. The contact spring piece of the detecting device is improved in durability by forming a flexible spring part, of a predetermined dimension, between an upright mounting plate part and a U-shaped spring part of the contact spring piece. The contact spring piece is made of a plate spring. The contact spring piece includes the upright mounting plate part, the U-shaped spring part, and the angled contact part such that a long spring span is formed between the upright mounting plate part and the angled contact part. The flexible spring part is made to flex by the load of the contact pressure of the object on the angled spring part. The mounting plate part, having at least one contact spring piece functioning as a terminal, is inserted into and fixed to a slit in a back plate of an L-shaped insulating stock so that the terminal extends from a lower part of the upright mounting plate part past a lower end of a base of the L-shaped insulating stock. The angled contact part, attached to the U-shaped spring part, extends in front of the back plate. A lower end of the angled contact part is inserted into a slit in the base of the L-shaped insulating stock and the lower end of the angled contact part is pressed toward a front end of the base. A top of the U-shaped spring part of the contact spring piece engages a stopping recess at an upper end of the back plate.

6 Claims, 8 Drawing Sheets

DEVICE FOR DETECTING OBJECTS MOVED DOWNWARDLY TO OPERATE A SWITCH

CROSS-REFERENCE TO RELATED APPLICATIONS

This application relates to and claims priority, under 35 U.S.C. §119, from Japanese Patent Application No. 11-206773 filed on Jul. 21, 1999, the entire contents of which are hereby incorporated by reference herein.

BACKGROUND OF THE INVENTION

1. Field of the Invention

The present invention generally relates to a device for detecting objects which have been transferred to operate a switch. The device has a contact which comes into contact with a set position (for example, a terminal) of a different kinds of objects, such as a digital video cassette (DVC) and all other types of cassette, a FD and all other types of discs, and so on. The objects have been transferred to operate a switch and thereby, perform different electrical detecting operations. More particularly, the present invention provides a device for detecting objects which have been transferred to operate a switch, wherein the device includes a flexible spring part formed between a mounting plate part and a U-shaped spring part in a contact spring piece, made of a plate spring. The device further includes the mounting plate part, the U-shaped spring part, and a contact part so as to allow for making the spring span longer to equalize, with high precision, the required load for the contact spring piece (i.e., the contact pressure of the contact with the object) and at the same time, to drastically improve the durability of the contact spring piece.

2. Discussion of Background

A device for detecting an object transferred to operate a switch has been conventionally used, wherein a set position of the transferred object, such as a DVC, other types of cassettes, etc., comes into contact with a contact of a contact spring piece to operate the switch, thereby performing different electrical detecting operations. Two kinds of devices have been used for detecting the object transferred to operate the switch, namely, one in which a contact spring piece is made of wire, and another in which a contact spring piece is made of a narrow and long plate spring piece.

The device for detecting an object, which has been transferred to operate a switch and which uses the contact spring piece made of wire as described above, is prepared, for example, as shown in FIG. 9. Referring to FIG. 9, a coil part 108 is shown as being elongatedly attached to the top of an upright mounting part 101. A contact spring piece A1 is elongatedly equipped with an angled contact part 103. The angled contact part 103 is the lower part of the contact spring piece A1. An upright mounting part 101 is inserted into a hole or slit 106 of a back plate 105 of an L-shaped insulating stock 104 and is fixed in the hole of slit 106. A lower end of the upright mounting part 101 extends outwardly past a lower end of a base 107 of the L-shaped insulating stock 104 to form a terminal 101*a*. A shaft 111 is inserted into the coil part 108. The angled contact part 103 extends outwardly in front of the back plate 105 of the L-shaped insulating stock 104. A lower end of the angled contact part 103 presses against the front end of a slit 110 of the base 107 of the L-shaped insulating stock 104.

Referring to FIG. 9, an object 109 is shown as being moved in a downward direction so as to contact an upper part of the angled contact part 103. Once contact between the object 109 and the angled contact part 103 is established, the object 109 is then continued to be moved downwardly towards a contact or top 103*a* of the angled contact part 103, while being in contact with the angled contact part 103. The contact between the object 109 and the angled contact part 103 creates a downwardly-directed load L1 and a cross-direction load L2 on the angled contact part 103. The downwardly-directed load L1, which moves the angled contact part 103 downwardly towards the bottom surface of the L-shaped insulating stock 104, is added to the cross-direction load L2, which moves the angled contact part 103 backwardly in the direction of the front surface of the back plate 105. The downwardly-directed load L1 and cross-direction load L2 act as a force for winding a coil of the coil part 108 so that a set position or terminal (not shown) of the object 109 contacts the contact or top 103*a* of the angled contact part 103. A bending load P5 is applied to the upper part of the contact spring piece A1 to compress and bend the angled contact part 103 of the contact spring piece A1 and the coil part 108 in cross-direction so as to operate the switch in order to perform detection of the object 109.

However, the detecting device of FIG. 9 has disadvantages with respect to the contact spring piece A1 which is made of wire and these disadvantages will be described in more detail, as follows:

(1). Since the coil part 108 is formed by three or four circular windings forming a coil, a certain amount of space is required, i.e., enough space for a shaft 111 of a predetermined diameter and for the width of the three or four circular windings of the coil. Therefore, further miniaturization of the detecting device is made more difficult to accomplish.

(2). Uniform and precise fabrication is not feasible because of the wire making up the contact spring piece A1. In other word, scatter occurs in every contact spring piece A1, particularly, in the spring constant.

(3). Since a shaft 111 should be inserted within the three or four windings of the coil of the coil part 108, the efficiency of the assembly is poor.

(4). Gold-plating of the angled contact part 103 is necessary, but it is not possible to gold-plate only the angled contact part 103 of the contact spring piece A1 because the wire material making up the contact spring piece is long and continuous and therefore, the overall length of the wire must be gold-plated with expensive gold, so that material costs are raised approximately two to three times what they would be if only the angled contact part 103 of the contact spring piece A1 had to be gold-plated.

The disadvantage described in (4) above is the most significant disadvantage.

In spite of having the above-described disadvantages, a contact spring piece A1 made of wire has the advantage of being very durable because the number of windings of the coil of the coil part 108 and the width of the coil can be adjusted.

A contact spring piece A2 can be made of, for example, a long and narrow plate spring. Such a contact spring piece A2 is shown in FIGS. 10 and 11. This type of contact spring piece A2 is coming into wider use as compensating for the disadvantages (1)–(4) of the above-described conventional contact spring piece made of wire.

However, it has become clear that the contact spring piece A2 made of a long and narrow plate spring is fatally poor in durability. A contact spring piece must have sufficient durability when it is subjected to a required load (i.e., contact pressure of the contact with an object). Thus, durability is the most important aspect of a contact spring piece.

This is true because it is the entire upright mounting plate part 101 (i.e., substantially up to a base of the U-shaped spring part 102 as shown in FIG. 10) that is inserted into the hole or slit 106 of the back plate 105 of the L-shaped insulating stock 104 and fixed to be immovable therein, when the contact spring piece A2 is mounted. The contact spring piece A2 includes the U-shaped spring part 102 and the angled contact part 103. The U-shaped spring part 102 is attached to the upper end of the upright mounting plate part 101. The angled contact part 103 is elongatedly attached to the lower part of the U-shaped spring part 102. Referring to FIGS. 11(*a*) and 11(*b*), the U-shaped spring part 102 is shown as having a greater width than the contact spring part 103, but a smaller width than the mounting plate part 101.

Referring again to FIG. 10, an obliquely downward load P1 is shown as acting on the upper portion of the angled contact piece 103 and a load P2 is shown as action on a portion of the U-shaped spring part 102. The load P2 compresses and bends the U-shaped spring part 102 in a cross-direction, when an obliquely downward load P1 is applied to the angled contact part 103 of the contact spring piece A2, by a synergistic action of the downwardly-directed load L1 applied to the angled contact part 103 and cross-direction load L2 due to contact of the object 109 with the angled contact part 103 and the further downward movement of the object 109 while being in contact with the contact part 103.

That is to say, the U-shaped spring part 102 is compressed and bent by the load P2 in the cross-direction. Thus, the U-shaped spring part 102 acts in a typical manner in that it is restored to its original state by a release of the load. Additionally, since the conventional contact spring piece A2, shown in FIGS. 10, 11(*a*) and 11(*b*), is not provided with the equivalent of the flexible spring part 8 of the present invention as shown in FIGS. 5, 6, 7, and 8(*a*)–(*d*), a flexible action does not occur when the object 109 moves downwardly toward the angled contact part 103 so as to frictionally contact the angled contact part 103. Consequently, metal fatigue, caused by frequent application and release of the load P2 on the relatively short span of the U-shaped spring part 102, is entirely concentrated on the U-shaped spring part 102 at a top thereof, so that the U-shaped spring part has the drawback of often breaking in short-term service.

Furthermore, when the required load (i.e., the contact pressure of the angled contact part 103 and the object 109) is adjusted by adjusting the width (thickness) of the plate piece of the U-shaped spring part 102, the load increases sharply by enlarging slightly the width (thickness) because the span between the upper end of the fixed upright mounting plate part 101 and the angled contact part 103 is short. Conversely, the load decreases sharply by diminishing slightly, thereby arising difficulty in adjustment. And, the width (thickness) of the U-shaped spring part 102 with a proper load obtained is extremely poor in durability. Accordingly, solutions to these problems are desirable.

SUMMARY OF THE INVENTION

The present invention improves the durability of the contact spring piece and solves the above-mentioned problems of the prior art contact spring pieces by providing a flexible spring part, being made of a plate spring piece and having predetermined dimensions, between the upright mounting plate part of the contact spring piece and the U-shaped spring part of the contact spring piece. The contact spring piece of the present invention, which is made of a plate spring piece, has performance superior to a contact spring piece made of wire, because the span between the upright mounting plate part and the angled contact part is lengthened and because the flexible spring part is provided so as to flex under the load of the contact pressure created when the object contacts the angled contact part.

That is to say, the present invention solves the above-described problems of the prior art by providing a detecting device, which detects when an object is moved downwardly to operate a switch. The detecting device includes a U-shaped spring part which is attached elongatedly to an upper end of an upright mounting plate part. The upright mounting plate part has a lower end which acts as a terminal. An angled contact part has a top or contact and the angled contact part is attached elongatedly to a lower end of the U-shaped spring part. Together the terminal, upright mounting plate part, U-shaped spring part, and angled contact part make up a contact spring piece. However, the different components of the contact spring piece have different widths. More particularly, the upright mounting plate part of the contact spring piece has a predetermined width, wherein the flexible spring piece has a width smaller than the upright mounting plate part, the U-shaped spring part has the same width as the flexible spring part, and the U-shaped spring part has a greater width than the angled contact part. The upright mounting plate part, of the contact spring piece, is inserted into a slit in a back plate of a L-shaped insulating stock and the upright mounting plate part is fixed therein. The upright mounting plate part has a terminal extending from a lower end thereof such that the terminal extends past a base of the L-shaped insulating stock. The angled contact part, attached to the U-shaped spring part, extends outwardly in front of the back plate of the L-shaped insulating stock. A lower end of the angled contact part is inserted into a slit in the base of the L-shaped insulating stock and a front of the angled contact part contacts a front end of the base of the L-shaped insulating stock. The present invention is characterized in that the contact spring piece has a flexible spring part of predetermined dimensions and the flexible spring part is located between the upright mounting plate part and the U-shaped spring part of the contact spring piece. Further, the upright mounting plate part has at least one contact spring piece and the upright mounting plate part is inserted into and fixed in a slit in the back plate of the L-shaped insulating stock such that a terminal extends from of lower part of the upright mounting plate part past a lower end of the base of the L-shaped insulating stock. The upper end of the U-shaped spring part is engaged with a stopping recess located at an upper end of the back plate of the L-shaped insulating stock. The angled contact part is located in front of the back plate of the L-shaped insulating stock, such that a lower end of the angled contact part is inserted into the slit in the base of the L-shaped insulating stock and is pressed to the front end of the base of the L-shaped insulating stock.

BRIEF DESCRIPTION OF THE DRAWINGS

A more complete understanding of the present invention may be had with reference to the following detailed explanations which are given in connection with the accompanying drawings, in which.

DETAILED DESCRIPTION OF THE PREFERRED EMBODIMENTS

Referring now to FIGS. 1–8, working examples of the present invention will be described in more detail below.

A device for detecting an object moved downwardly to operate a switch is provided. The detecting device includes a U-shaped spring part 2 which is attached elongatedly to an upper end of an upright mounting plate part 1. The upright mounting plate part has a lower end, which is made of a plate spring piece for acting as a terminal 1*a*. An angled contact part 3 has a top or contact 3*a* which is attached to the lower end of the U-shaped spring part 2. The upright mounting plate part 1, the U-shaped spring part 2, and the angled contact part 3 are all components of a contact spring piece A. The components forming the contact spring piece A are not all of the same width. For instance, the upright mounting plate part 1 has a width which is greater than the width of the U-shaped spring part 2 and the U-shaped spring part 2 has a width which is greater than the width of the angled contact part 3, as can be clearly seen from FIGS. 8(*b*) and 8(*d*).

Figure 5:
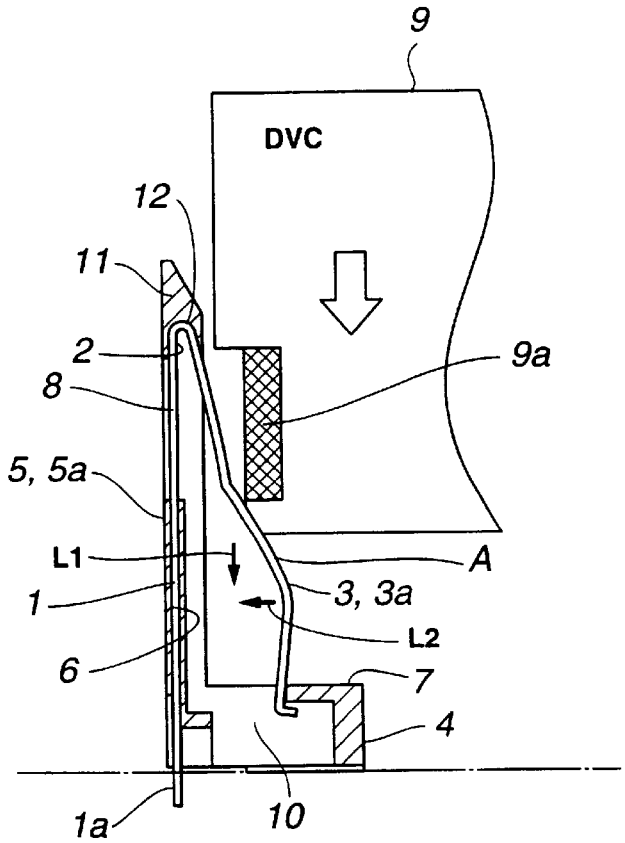
FIG. 5 is a cross-sectional view of the detecting device taken along line a 5—5 of FIG. 1.
Figure 6:
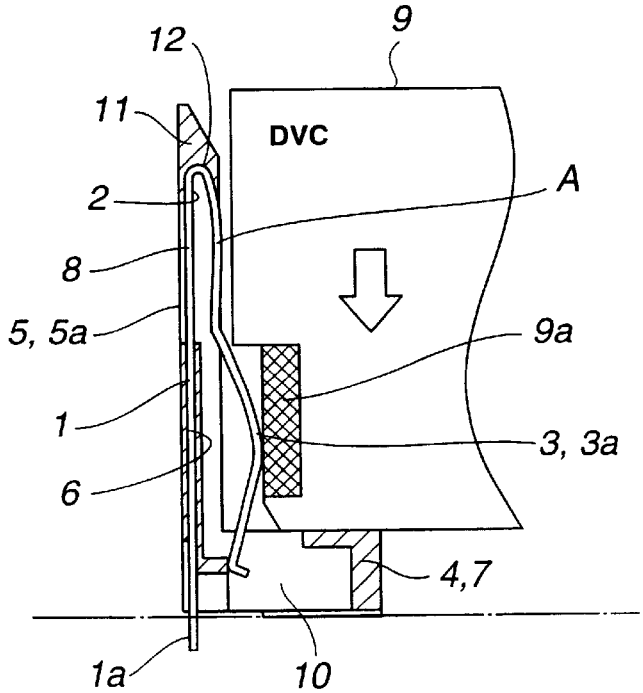
FIG. 6 is a cross-sectional view showing operation of the detecting device of FIG. 5, wherein a top or contact 3*a* of the angled contact part 3 is in contact with a set position 9*a* (for example, a terminal) of an object 9 (for example, a DVC or other type of cassette or disk, etc.)
Figure 7:
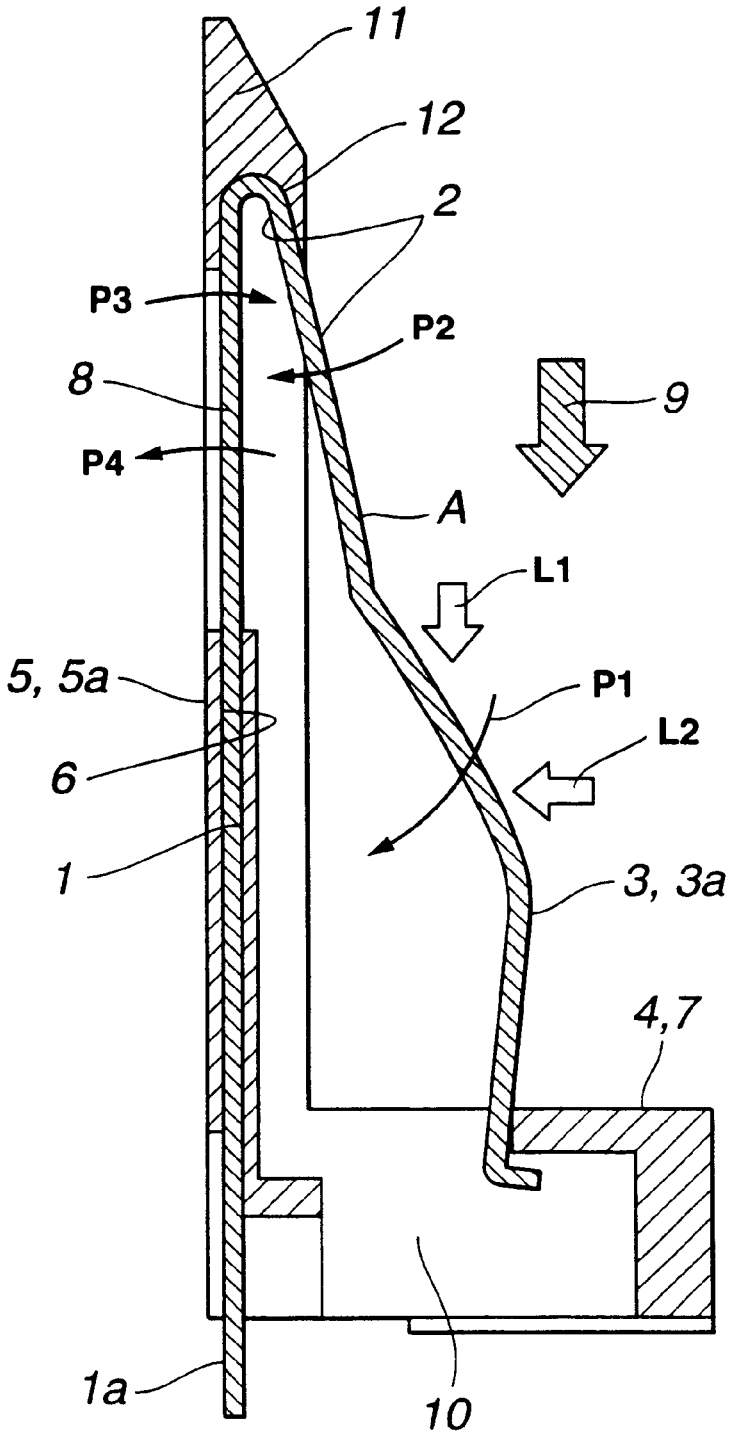
FIG. 7 is a cross-sectional view for explaining the operation of a contact spring piece A of the present invention.
Figure 8A:
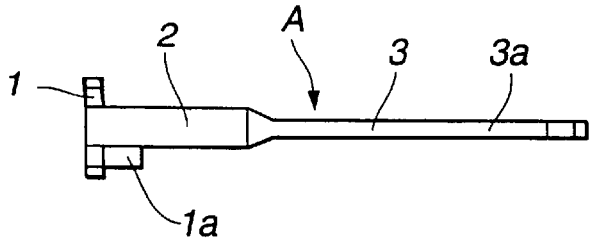
FIGS. 8(*a*)–(*d*) are a front view, plan view, right side view, and left side view, respectively, of a contact spring piece A of the present invention.
Figure 8B:
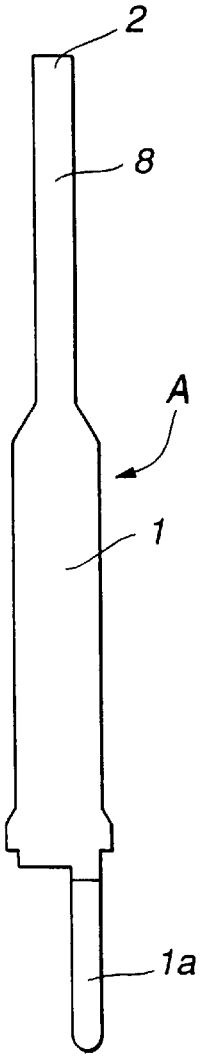
Figure 8C:
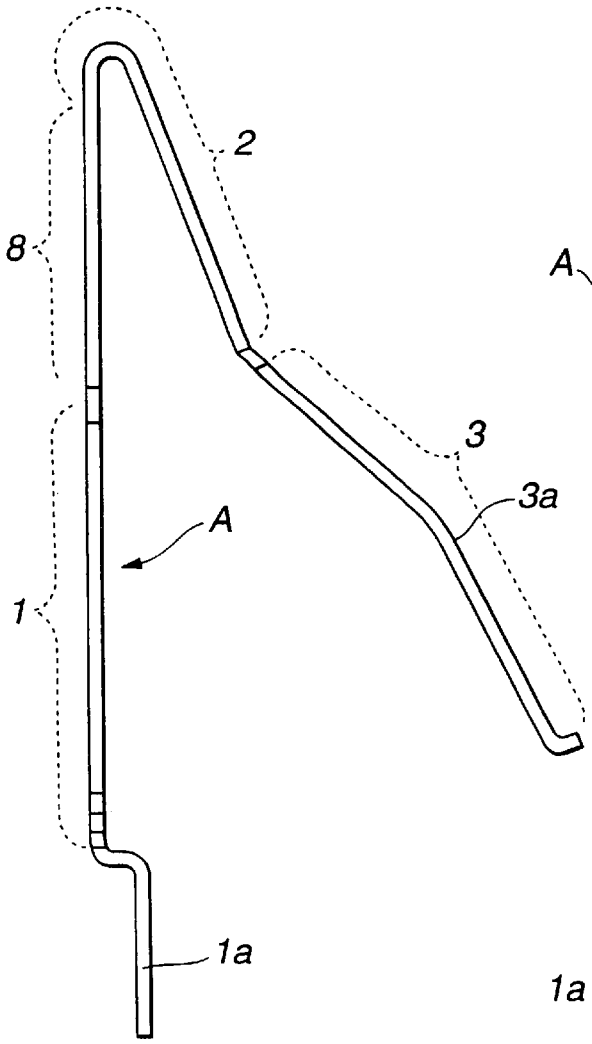
Figure 8D:
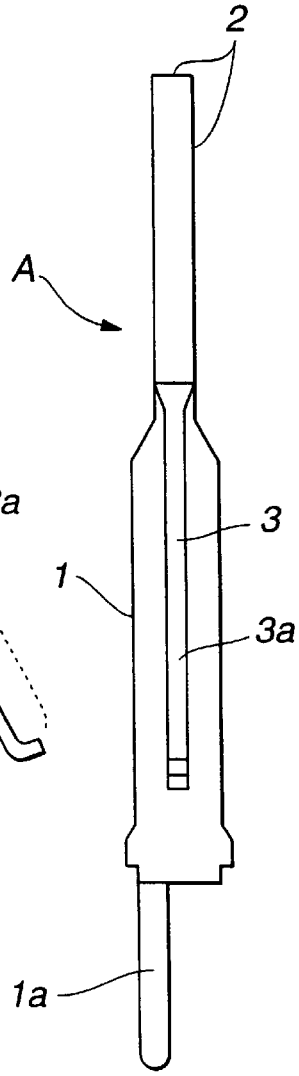
Figure 9:
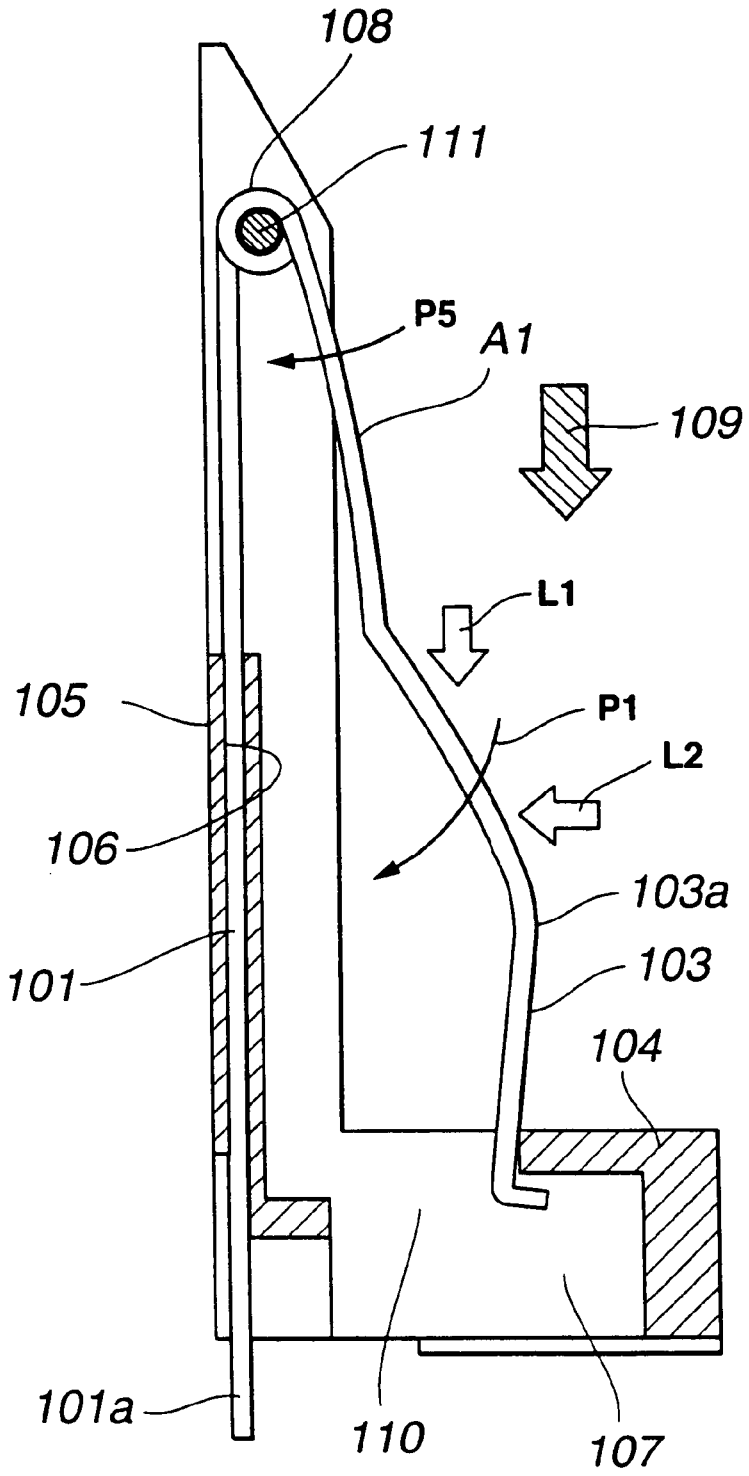
FIG.9 PRIOR ART
FIG. 9 is a cross-sectional view for explaining the operation of a conventional detecting device, wherein the contact spring piece A1 is made of wire.
Figure 10:
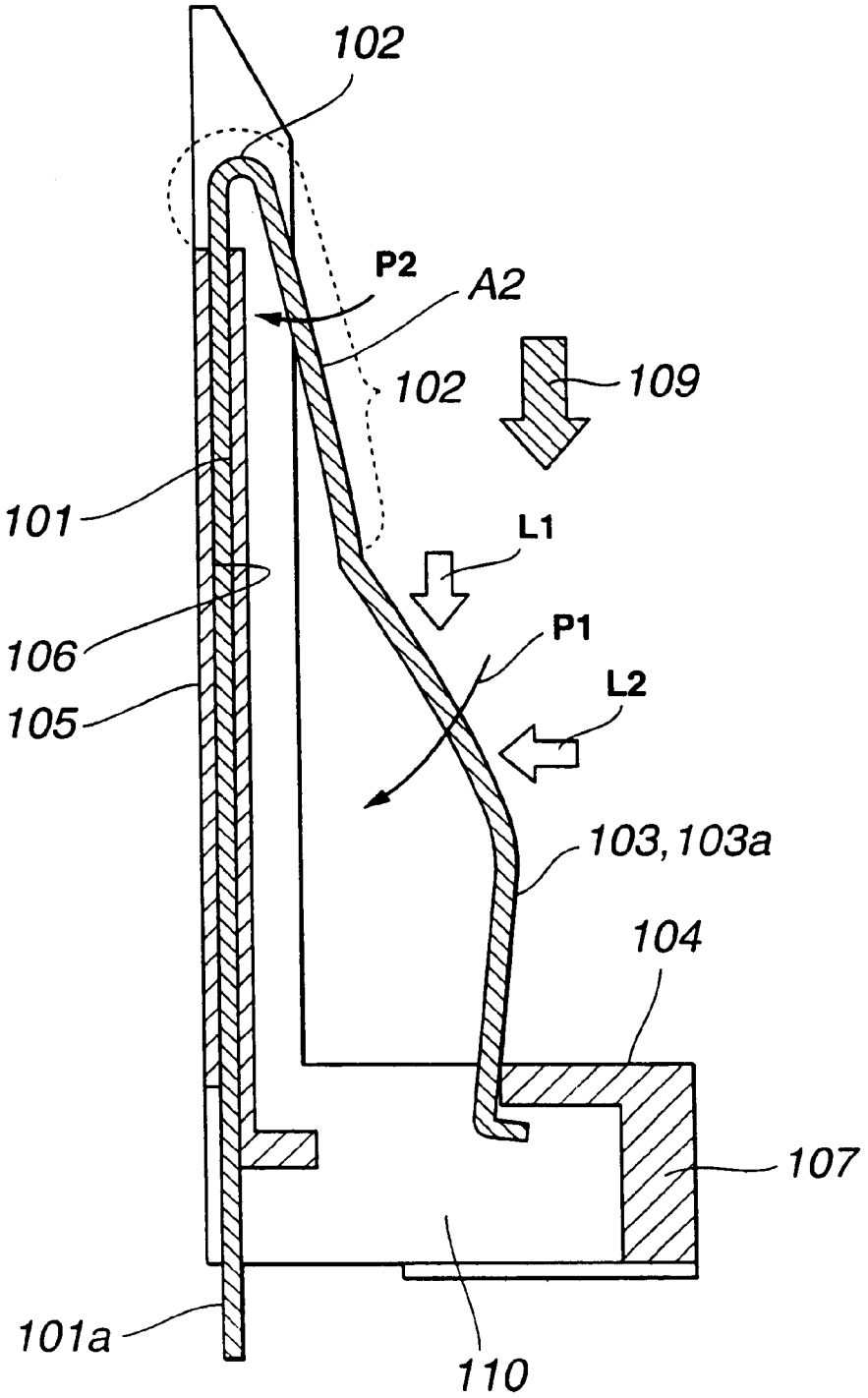
FIG.10 PRIOR ART
FIG. 10 is a cross-sectional view for explaining the operation of another conventional detecting device, wherein the contact spring piece A2 is made of a plate spring.
Figures 11A, 11B:
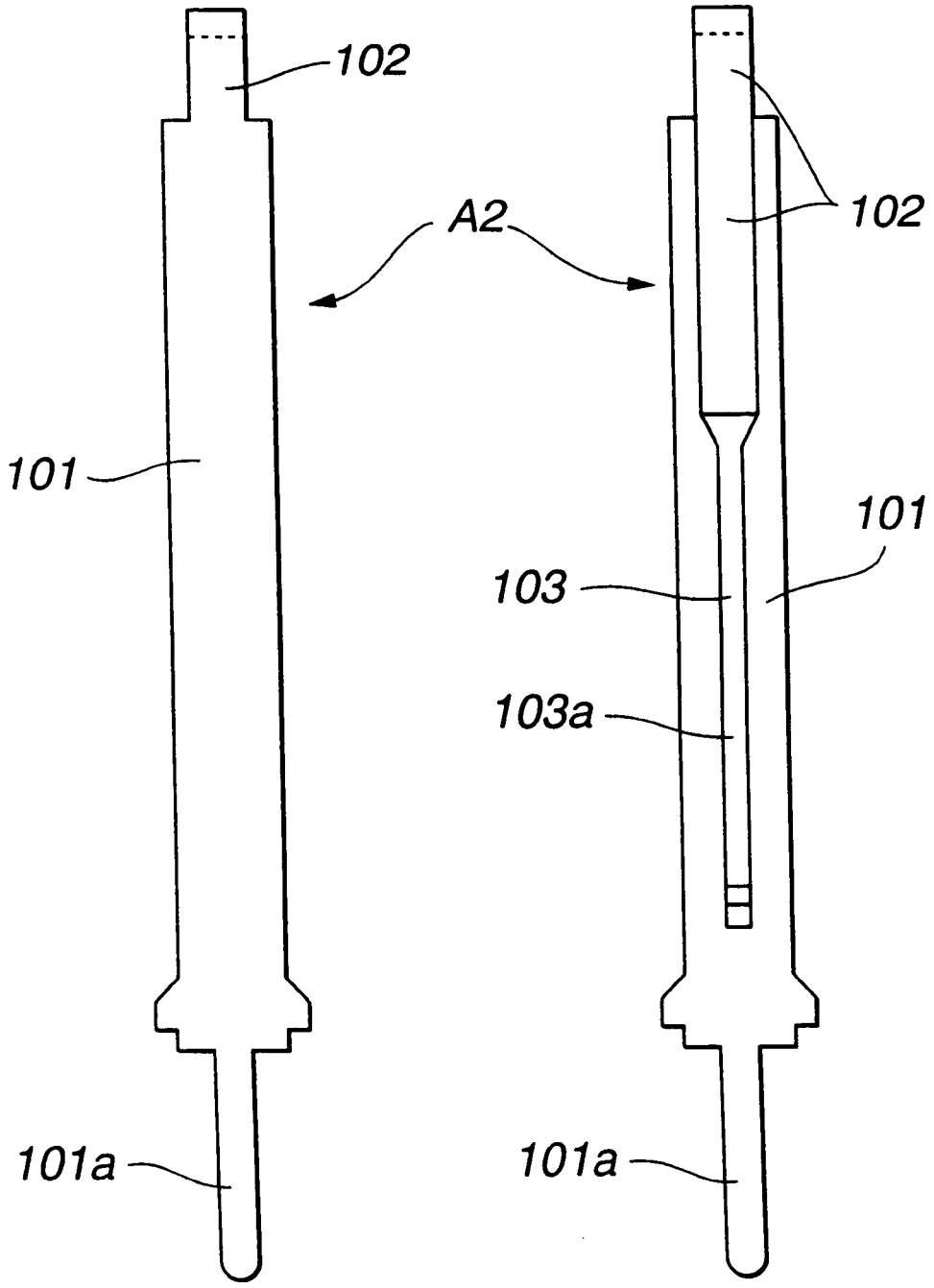
FIG. 11A PRIOR ART
FIG. 11B PRIOR ART
FIGS. 11(*a*) and 11(*b*) are a right side view and a left side view, respectively, of the contact spring piece A2 of FIG. 10.

Referring to FIG. 5, it can be seen that the upright mounting plate part 1 is inserted into and fixed to a slit 6 in a back plate 5 of a L-shaped insulating stock 4. The upright mounting plate part 1 has a contact spring piece extending from a first end thereof. The contact spring piece extending from the first end of the upright mounting plate part acts as a terminal 1*a* and extends past a lower end of the base 7 of the L-shaped insulating stock 4. The angled contact part 3, which is attached to the lower end of the U-shaped spring part 2, extends in front of the back plate 5 of the L-shaped insulating stock 4. The lower end of the angled contact part 3 is inserted into a slit 10 in the base 7 of the L-shaped insulating stock 4. The angled contact part 3 is pressed towards a front end of the base of the L-shaped insulating stock 4.

The present invention is characterized in that the contact spring piece A includes a flexible spring part 8. The flexible spring part 8 has a predetermined dimension and functions as a contact spring piece between the upright mounting plate part 1 and the U-shaped spring part 2 as is clearly shown in FIGS. 8(*a*)–(*d*).

The upper end of the U-shaped spring part 2 is engaged with a stopping recess 12, which is formed on the upper end 11 of the back plate 5 of the L-shaped insulating stock 4.

Figure 1:
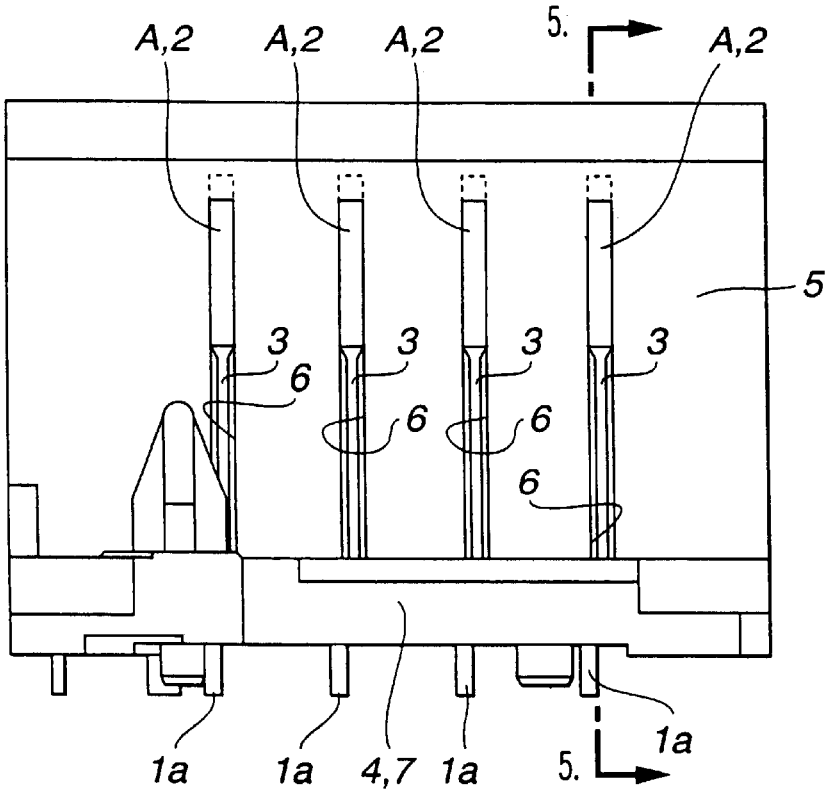
FIG. 1 is a front view of a working example of a device for detecting an object 9 moved downwardly to operate a switch of the present invention.
Figure 2:
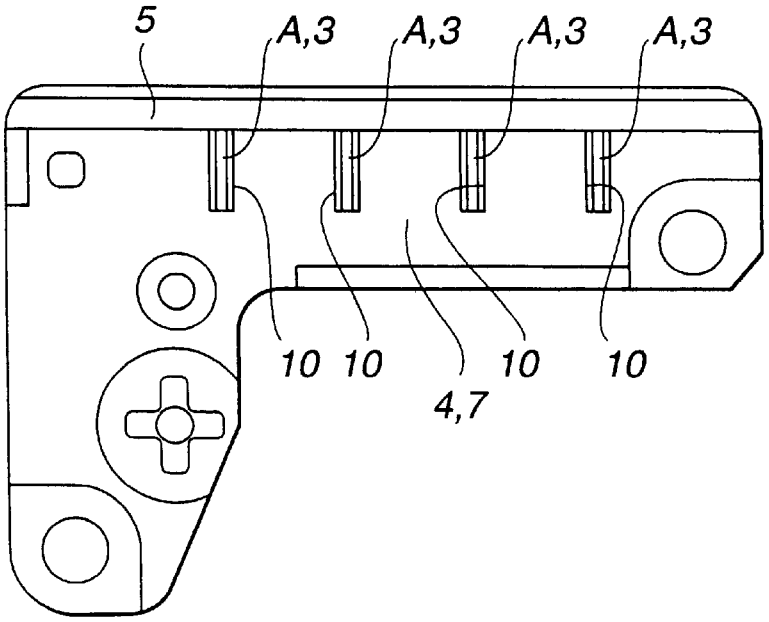
FIG. 2 is top plan view of detecting device of FIG. 1.
Figure 3:
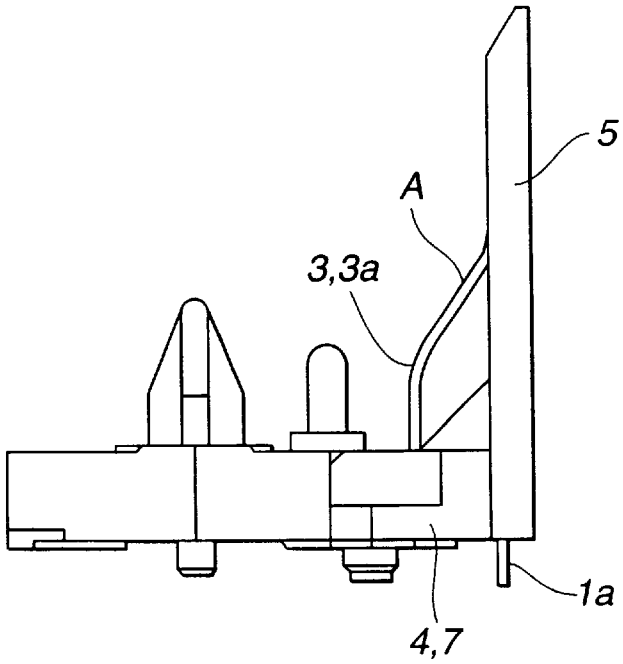
FIG. 3 is a right side elevational view of the detecting device of FIG. 1.
Figure 4:
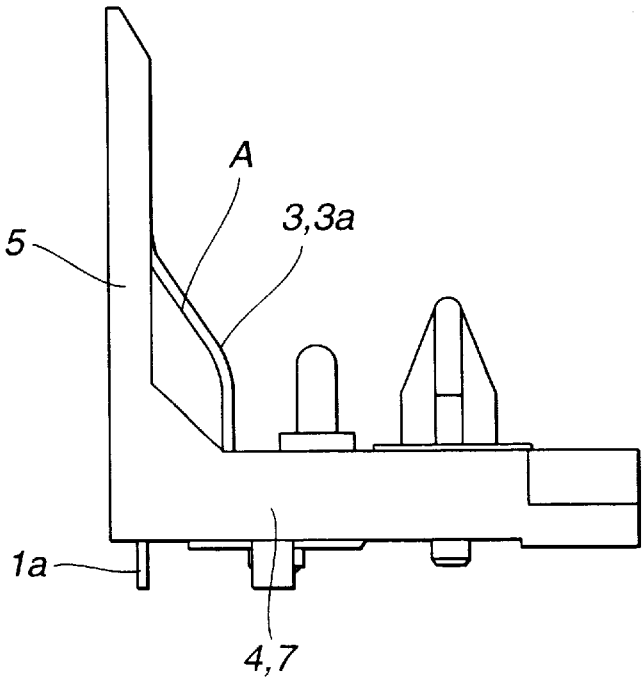
FIG. 4 is a left side elevational view of the detecting device of FIG. 1.

As stated above, the width of the U-shaped spring part 2 of the contact spring piece A is formed so as to be smaller than the width of the upright mounting plate part 1. Because the spring constant increases when the width of the U-shaped spring part 2 of the contact spring piece A is the same as that of the upright mounting plate part 1, the width of the angled contact part 3 attached to the U-shaped spring part 2 is formed so as to be smaller than the width of the U-shaped spring part, if necessary. This is because the load of the angled contact part 3, which comes into contact directly with the object 9, can be easily equalized. The load is reduced and mutual spaces between parallel and adjacent contact spring pieces A (i.e., four contact spring pieces A are shown in FIGS. 1 and 2) are widened, when the angled contact pieces 3 are in contact with the object 9.

When the flexible spring part 8 is mounted between the upright mounting plate part 1 of the contact spring piece A and the U-shaped spring part 2 of the contact spring piece A as in the present invention and when the entire dimension of the contact spring piece A is not changed, then approximately one third (⅓) of the upper portion of the upright mounting plate part 1 is formed so as to have the same width as the width of the U-shaped spring part 2 and thus, the U-shaped spring part 2 and the angled contact part 3 are left as they are, which is the flexible spring part 8.

The object 9 is moved downwardly to contact the top or contact 3*a* of the angled contact part 3 of the contact spring piece A. Then, as the object is continued to be moved downwardly, the object remains in contact with and moves along the top or contact 3*a* of the angled contact part 3 of the contact spring piece A so that the top or contact part 3*a* of the angled contact part 3 comes into contact with a set position 9*a* (for example, a terminal) of the object 9 in order to operate the switch to perform the detection function.

During the downward movement of the object 9 with respect to the angled contact part 3, an oblique downward load P1 is applied to the angled contact part 3 of the contact spring piece A by a synergistic action of a downwardly-directed load L1. The downwardly-directed load L1 is applied in such a way that the flexible spring part 8 and the U-shaped spring part 2 are pulled downwardly by contact friction from the object 9 as the object 9 is being moved downwardly into contact with the upper portion of the angled contact part 3 of the contact spring piece A and moved further downwardly toward the top or contact 3*a* while the object 9 remains in contact with the upper portion of the angled contact part 3. In addition, a cross-direction load L2 is applied to the contact spring piece A so as to compress and bend the U-shaped spring part 2 toward the back plate 5 of the L-shaped insulating stock 4 while the object 9 is being moved downwardly to contact the angled contact part 3 and then is moved further downwardly towards the top or contact 3*a* of the angled contact part 3 while the object 9 remains in contact with the upper part of the angled contact part 3. A load P4, which makes the flexible spring part 8 flex in the cross-direction, synergistically acts because the cross-direction load P2, for compressing and bending the U-shaped spring part 2 in the cross-direction, and the load P3, for making the flexible spring part 8 flex in forward-bent direction, are suppressed at the stopping recess 12.

According to the present invention, the span between the upright mounting plate part 1 and the U-shaped spring part 2 can be lengthened by providing the flexible spring part 8 between the upright mounting plate part 1, which is immovably fixed in the slit in the back plate of the L-shaped insulating stock, and the U-shaped spring part 2. Therefore, when the downward load L1 and the cross-direction load L2 are applied synergistically on all of the components of the contact spring piece A, namely, the U-shaped spring part 2, the flexible spring part 8, and the angled contact part 3, from the object 9 being moved downwardly into contact with the angled contact part 3 and being moved further downwardly toward the top or contact 3*a* of the angled contact part 3 while the object remains in contact with the upper part of the angled contact part 3, the top or contact 3*a* of the angled contact part 3 comes into contact with the set position 9*a* of the object 9, so that a spring action and a compression-bending action act synergistically. The spring action corresponds to the downwardly-directed load L1 and the compression-bending action corresponds to the cross-direction load L2. Both of the spring action and the compression-bending action act synergistically, and accordingly, the flexible spring part 8 does not flex and the U-shaped spring part 2 is not compressed and bent. However, the flexible spring part 8 and the U-shaped spring part 2, as a whole, are made to flex and are compressed and bent. As a result, the present invention makes it possible to improve the durability of the contact spring piece A in a different manner than conventional contact spring pieces. More particularly, conventional contact spring pieces, which are made of a plate spring, are broken in short-term service because only the U-shaped spring parts thereof (i.e., not the flexible spring parts, because conventional contact spring pieces made of plate springs do not have flexing spring parts) are strongly and repeatedly compressed and bent and restored to the original state so as to be susceptible to fatigue failure.

Similarly, since the span between the upright mounting plate part 1 and the U-shaped spring piece 2 can be set lengthened by providing the flexible spring part 8 of the present invention, the required loads (i.e., the contact pressure of the top of contact 3*a* of the angled contact part 3 on the set position 9*a* of the object 9) can be easily obtained, even if the width of the U-shaped spring part 2 and the angled contact part 3 is enlarged. Accordingly, a load adjustment range can be widely set and an adjustment can be made easily, thereby also improving the durability.

What is claimed is:

1. A device for detecting an object in order to operate a switch, said device comprising:

an insulating stock including:

a base which is approximately L-shaped in top plan view, said base having at least one slit therein;

a back plate extending upwardly from a top surface of said base, said back plate having at least one slit therein; and at least one stopping recess at an upper end of said back plate; and at least one contact spring piece including:

a mounting plate part having first and second ends and a predetermined width;

a flexible spring part having first and second ends and a predetermined width which is thinner than a predetermined width of said mounting plate part, said first end of said flexible spring part being connected to said second end of said mounting plate part;

an U-shaped spring part having first and second ends and a U-shaped portion located between said first and second ends, said first end of said U-shaped spring part being connected to said second end of said flexible spring part, and said U-shaped spring portion of said U-shaped spring part having an approximately same contour as an inner surface of said at least one stopping recess; and an angled contact part having first and second ends and a contact located between said first and second ends, said first end of said angled contact part being connected to said second end of said U-shaped spring part;

wherein said at least one contact spring piece is mounted on said insulating stock by said mounting plate part being inserted into and fixedly mounted in said at least one slit in said back plate of said insulating stock, said flexible spring part being unrestrained throughout its entire length between said mounting plate part and said U-shaped spring part, said U-shaped portion of said U-shaped spring part being mounted in said stopping recess of said back plate of said insulating stock, and a lower portion of said angled contact part being inserted so as to be movable in said at least one slit in said base of said insulating stock such that when the object to be detected is moved in a predetermined direction into contact with a top portion of said angled contact part and while remaining in contact, the object is slid along said top portion of said angled contact part until a set position of the object contacts said contact of said angled contact part, the object causes loads to act on said contact spring piece to compress said contact spring piece so that said angled contact part is moved toward said back plate in order for said flexible spring part to flex to absorb stresses created by compression of said contact spring piece and for said U-shaped portion of said U-shaped spring part to engage said at least one stopping recess of said back plate of said insulating stock so that said U-shaped portion is restrained from bending.

2. The device of claim 1, wherein said contact spring piece further comprises a terminal having first and second ends, said first end of said terminal being a free end and said second end of said terminal being connected to a first end of said mounting plate part such that said terminal extends past a bottom surface of said base on said insulating stock.

3. The device of claim 2, wherein said terminal has a predetermined width which is much less that said predetermined width of said mounting plate part so that said terminal is offset right or left from a centerline of said mounting plate part.

4. The device of claim 3, wherein said terminal and said mounting plate part each have predetermined thickness which are approximately equal to each other such that a centerline of said predetermined thickness of said terminal is contained in a plane that is parallel to a plane containing a centerline of said predetermined thickness of said mounting plate part so that said terminal and said mounting plate part form a somewhat flattened S-shaped connection in right-side elevational view.

5. The device of claim 1, wherein said U-shaped spring piece has a predetermined width which is approximately equal to said predetermined width of said flexible spring part and said angled contact part has a predetermined width which is less than said predetermined widths of said U-shaped spring piece and said flexible spring part.

6. The device of claim 1, wherein said flexible spring part has a predetermined length which is approximately one-half of a predetermined length of said mounting plate part such that said predetermined length of said flexible spring part is approximately one-third of a total length of said predetermined length of said mounting plate part added to said predetermined length of said flexible spring part.

* * * * *